United States Patent [19]

Prewer et al.

[11] Patent Number: 4,986,041

[45] Date of Patent: Jan. 22, 1991

[54] PREFABRICATED ELEVATOR SHAFT MODULES

[75] Inventors: John R. Prewer, Bapchild; Leslie B. Power, Epsom, both of England

[73] Assignee: Inventio AG, Switzerland

[21] Appl. No.: 452,965

[22] Filed: Dec. 19, 1989

[30] Foreign Application Priority Data

Dec. 19, 1988 [GB] United Kingdom ..... 8829603

[51] Int. Cl.[5] ..... B66B 9/00; E04B 1/00; E04B 1/344

[52] U.S. Cl. ..... 52/79.5; 52/264; 52/265; 52/270; 187/1 R

[58] Field of Search ..... 52/69–71, 52/79.5, 79.1, 281–282, 284, 264, 483, 127.12, 127.7; 220/6; 187/1 R

[56] References Cited

U.S. PATENT DOCUMENTS

| | | | |
|---|---|---|---|
| 1,100,273 | 6/1914 | Wiard | 52/69 X |
| 1,180,771 | 4/1916 | Haeske | 220/6 |
| 2,613,951 | 10/1952 | Rusnak | 220/6 |
| 3,110,907 | 11/1963 | King | 4/2 |
| 3,254,786 | 6/1966 | Melville | 220/6 |
| 3,434,253 | 3/1969 | Hatcher | 52/69 |
| 3,498,587 | 3/1970 | Friedberg | 52/70 X |
| 3,984,949 | 10/1976 | Wahlquist | 52/70 |
| 4,231,148 | 11/1980 | Harding | 29/469 |
| 4,242,845 | 1/1981 | Osborne Sr. | 52/69 |
| 4,708,222 | 11/1987 | Bills et al. | 187/1 R |
| 4,779,707 | 10/1988 | Smith et al. | 52/264 |

FOREIGN PATENT DOCUMENTS

| | | | |
|---|---|---|---|
| 1174425 | 9/1984 | Canada | 187/1 R |
| 1683086 | 1/1971 | Fed. Rep. of Germany . | |
| 2187663 | 1/1974 | France . | |
| 2410604 | 8/1979 | France | 220/6 |
| 90202 | 5/1972 | German Democratic Rep. . | |
| 398048 | 8/1965 | Switzerland . | |
| 574508 | 9/1977 | U.S.S.R. | 52/69 |
| 1344715 | 10/1987 | U.S.S.R. | 187/1 R |
| 2015615 | 9/1979 | United Kingdom . | |

*Primary Examiner*—David A. Scherbel
*Assistant Examiner*—Deborah McGann Ripley
*Attorney, Agent, or Firm*—Marshall & Melhorn

[57] ABSTRACT

A prefabricated elevator shaft module is foldable for volume reduction for transport and storage. The side walls of the module each include hinge points defining two vertical axes, one axis being inwardly foldable and the other axis being outwardly foldable. When the walls are folded together, apertures in a lower angle frame and a hinge lug are aligned for the insertion of a bolt for the mechanical fixation in the folded together position.

13 Claims, 3 Drawing Sheets

PREFABRICATED ELEVATOR SHAFT MODULES

BACKGROUND OF THE INVENTION

The present invention relates in general to elevators and, in particular, to prefabricated elevator shaft modules for constructing elevator shafts in building structures.

The use of prefabricated elevator shaft modules has the advantages of shortened construction time and lower costs. Disadvantages are the bulky volume of such modules which renders the storage and the transport very difficult, so that the construction cost advantages are partly lost.

Prefabricated elevator shaft modules which are brought to the building site in individual components and are there assembled into a ready module are known. A French patent application No. 2,187,663 describes a prefabricated elevator shaft module which includes all mechanical components as well as the shaft door. This elevator shaft module can be transported assembled as a bulky structure or it can be assembled readily at the building site from supplied individual parts or components. Increased costs due to the requirement for special vehicles to transport the assembled module reduce the construction cost savings and the modules are also subjected to the danger of damage.

The present invention is based on the problem to create an elevator shaft module by which it is possible to achieve a reduction of module volume by a reduction in one of the three linear measurements defining the volume.

SUMMARY OF THE INVENTION

The present invention concerns a prefabricated module for constructing an elevator shaft. The prefabricated elevator shaft modules are folded together for storage and transport in such a manner, that one of the linear measurements defining the volume of the module is approximately one third of its value in the assembled state. The stability and the appearance of the finished assembled module is not influenced and the rigidity or stiffness of the corner construction is not reduced. Furthermore, the folding together and the unfolding is possible without the use of special tools and the module is fixed in the folded state which prevents an unintentional opening. The folded module facilitates the storage and the transport of elevator shaft modules.

The prefabricated elevator shaft module for the construction of complete elevator shafts in building structures comprises a plurality of generally vertically extending walls, including a pair of spaced apart side walls connected to each other by front and rear walls, each of the side walls being foldable along two generally vertically extending axes. When the side walls are folded, the depth of the module is decreased to approximately one third of its unfolded depth. The elevator shaft module has a rectangular cross section in its erected state and the side walls include four vertically arranged hinges, two of the hinges being the same distance from the ends of a first one of the side walls of the module as the other two other hinges are from the ends of the other side wall opposing the first side wall.

The walls are formed from a plurality of individual elements having flanged side edges. The upper and lower ends of the walls are attached to upper and lower angle frames respectively. One of the two axes is defined at abutting edges of adjacent ones of the individual elements and each of the upper and lower angle frames has a gap formed therein as a continuation of the one axis. A pair of hinge lugs each have one portion fixedly attached to an associated one of the angle frames on one side of the gaps and another portion detachably attached to an associated one of the angle frames on the other side of the gaps to permit the side walls to fold outwardly along the one axis. The other one of the two axes is defined at abutting edges of adjacent ones of the individual elements and each of the upper and lower angle frames has a gap formed therein as a continuation of and horizontally at an angle to the other axis. A pair of hinge lugs each having one portion fixedly attached to an associated one of the angle frames on one side of the gaps and another portion detachably attached to an associated one of the angle frames on the other side of the gaps to permit the side walls to fold inwardly along the other axis. The hinge lugs and angle frames adjacent the other axis each have an aperture formed therein for retaining a bolt to fix the side walls in a folded position.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
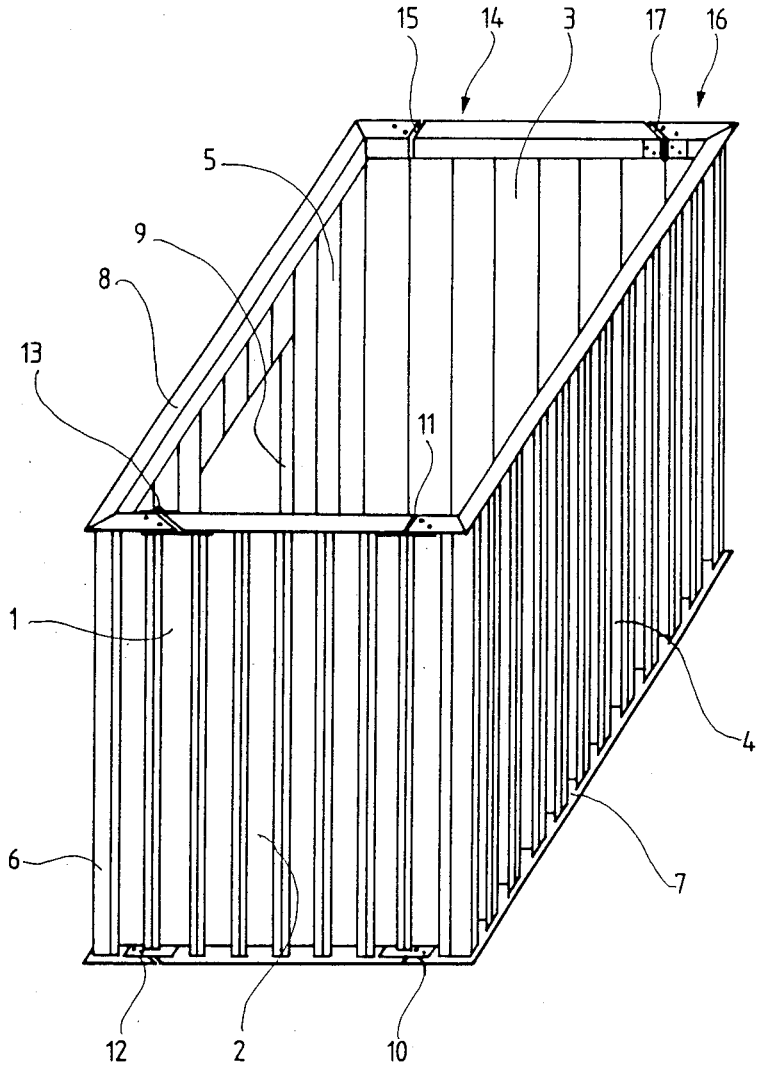
FIG. 1 is a perspective view of an elevator shaft module according to the present invention.

FIG. 1 shows an elevator shaft module 1 which formed by a pair of spaced apart side walls 2 and 3 connected by a rear wall 4 and a front wall 5. The walls 2 through 5 are each constructed of a plurality of identical individual elements 6. A lower angle frame 7 and an upper angle frame 8 are attached to the lower and upper edges respectively of the walls. The front wall 5 has a door opening 9 formed therein The elements 6 are designed with symmetrical folded profiles and are welded together with the angle frames 7 and 8.

Figure 2:
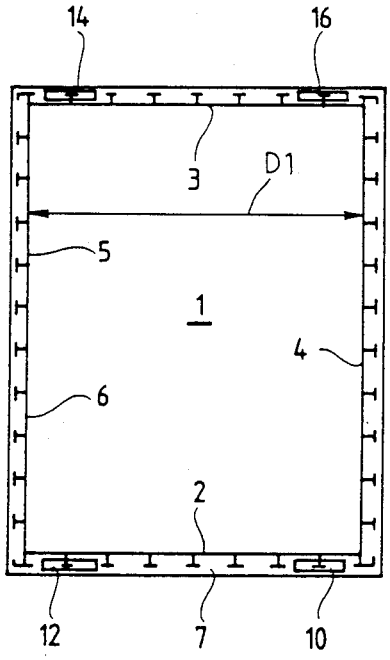
FIG. 2 is a horizontal cross sectional view of the elevator shaft module shown in FIG. 1.

The lower angle frame 7 includes hinge points 10 and 12 in the side wall 2 and hinge points 14 and 16, visible in FIG. 2, in the side wall 3. The upper angle frame 8 includes corresponding hinge points 11, 13, 15 and 17. FIG. 2 also shows the shape of the profiles of the individual elements 6 which have an outwardly extending flange formed along each side edge, the outer edges of the flanges extending toward one another.

Figure 3:
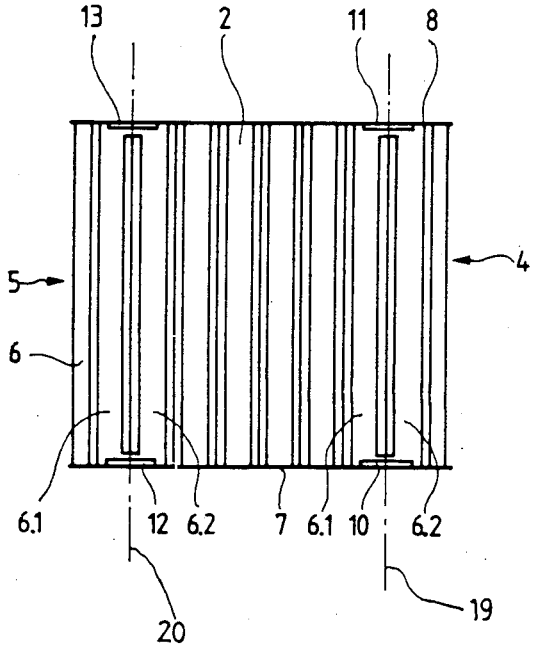
FIG. 3 is a side elevation view of the elevator shaft module shown in FIG. 1.

FIG. 3 shows the side wall 2 with the hinge points 10, 11, 12 and 13. The individual elements 6 adjacent the hinge points are designated as 6.1 and 6.2. The abutting flanges of the elements 6.1 and 6.2 are cut back by several centimeters at the upper and lower ends adjacent the hinge points 10, 11, 12 and 13. The hinge points 10 and 11 define a swivel or folding axis 19 and the hinge points 12 and 13 define a folding axis 20, each such axis extending generally vertically between the individual elements 6.1 and 6.2. The side wall 3 is constructed in a similar manner.

Figure 4:
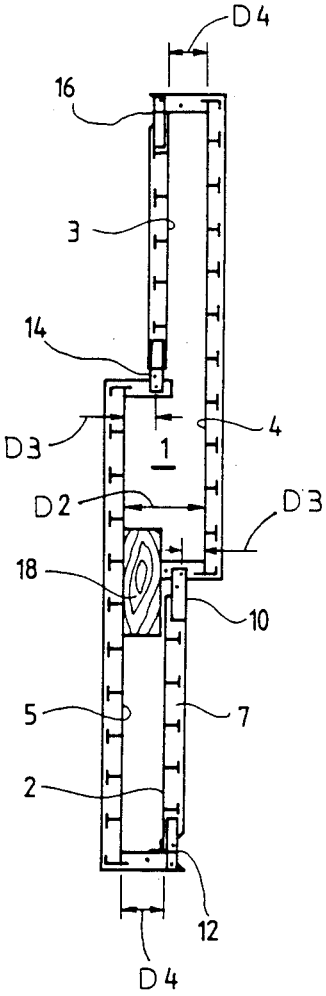
FIG. 4 is a cross sectional view similar to FIG. 2 with the module shown in the folded together position.

FIG. 4 shows the module 1 in the folded together position. Opposed ends of the side walls 2 and 3 are spaced a predetermined distance D2 apart. The depth of the module 1 has been reduced from a predetermined distance D1 shown in FIG. 2. A rectangular cross section timber 18 serves as an intermediate layer between the walls 2 and 5 for taking up laterally acting forces during transport and storage.

Figure 5:
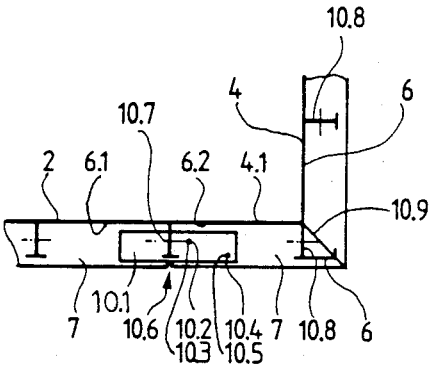
FIG. 5 is an enlarged fragmentary view of an outwardly foldable hinge point shown in FIG. 2.

FIG. 5 shows the details of the outwardly foldable hinge point 10. The hinge point 10 is identical to the hinge points 11, 14 and 15. The lower angle frame 7 is severed to form a gap or space 10.6 in the continuation of the boundary position between the individual elements 6.1 and 6.2

A short module leg 4.1 is solidly connected at right angles with the back wall 4. A left portion of a generally planar hinge lug 10.1 is welded onto the horizontally extending leg of the left hand portion of the lower angle frame 7 adjacent the side wall 2. A right portion of the hinge lug 10.1 is bolted to a right hand portion of the horizontal leg of the lower angle frame 7 and thus to the short module leg 4.1 by means of two apertures 10.2 and 10.4 and two associated bolts 10.3 and 10.5. A detachable bolt 10.7 connects the abutting flanges of the individual elements 6.1 and 6.2 together. Nondetachable connecting points 10.8 are located on the flanges of the other individual elements 6. A welded corner connection 10.9 attaches the abutting ends of the sections of the lower angle frame 7.

Figure 6:
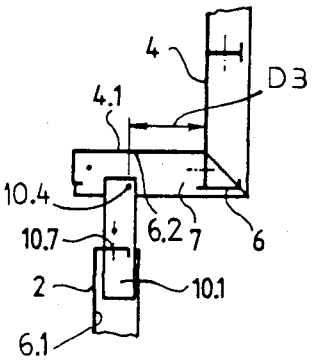
FIG. 6 is a view similar to FIG. 5 with the hinge point in an open position.

FIG. 6 shows the outwardly foldable hinge point 10 in the opened position. The angle of opening is about 90°. The bolt connections 10.7 and the bolt 10.3 are removed. The center of the aperture 10.4 lies in the same vertical plane as the facing short flange edges of the individual elements 6.1 and 6.2, whereby no wedging or interference is possible during the opening of the hinge point 10 and associated hinge point 11. The hinge point at the center of the aperture 10.4 is spaced a distance D3 from the adjacent end of the wall 4.

Figure 7:
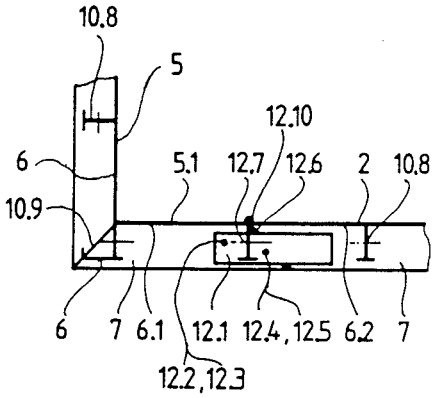
FIG. 7 is an enlarged fragmentary view of an inwardly foldable hinge point shown in FIG. 2.

FIG. 7 shows the details of the inwardly foldable hinge point 12 which is identical to the hinge points 13, 16 and 17. It is located between the side wall 2 and a short module leg 5.1, which leg is solidly connected at right angles with the front wall 5. A detachable hinge 12.10 is bolted to the vertical leg of the lower angle frame 7 at the point of rotation of the hinge point 12. A space or gap 12.6 is formed in the lower angle frame 7, starting from the center of the hinge 12.10 and extending, at an angle of 45°, outwardly through the horizontal leg. A right portion of a generally planar hinge lug 12.1 is welded onto the horizontal leg of the right hand portion of the lower angle frame 7 at the side wall 2. The left portion of the hinge lug 12.1 is bolted by two apertures 12.2 and 12.4 and two associated bolts 12.3 and 12.5 to the left hand portion of the lower angle frame 7 and thus to the short module leg 5.1. Detachable bolts 12.7 connect the flanges of the individual elements 6.1 and 6.2 together.

Figure 8:
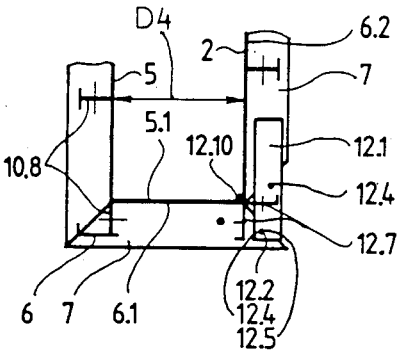
FIG. 8 is a view similar to FIG. 7 with the hinge point in an open position.

FIG. 8 shows the inwardly foldable hinge point 12 in the opened position. The angle of opening is about 90°. The detachable bolt connections 12.7 are released and the bolts 12.3 and 12.5 are removed. In the opened position and at an angle of 90°, the aperture 12.2 of the hinge lug 12.1 lies precisely aligned above the aperture 12.4 in the lower angle frame 7. The bolt 12.5 can be inserted in these apertures to fix the hinge point 12 in this position. The hinge point at the center of the hinge 12.10 is spaced a distance D4 from the adjacent end of the wall 5.

The above described module operates in the following manner: After releasing the described bolts at all hinge points, the module 1 can be folded together in such a way that its cross section reduces to the shape according to FIG. 4. Thus, the depth measurement of the module 1, between the front wall 5 and the rear wall 4, is reduced to about one third in comparison to the open position so that, for instance, three such modules 1 can be accommodated side-by-side on one truck trailer. As shown in FIGS. 2 and 3, a depth measurement of a first predetermined distance D1 between the front wall 5 and the rear wall 4 when the module 1 is open is reduced to a second predetermined distance D2 when the module 1 is folded, D2 being about one third of D1. The distance D3 can be selected such that the distance D2 is about twice the distance D4 as shown in FIG. 4. The bolts 12.5 at the inwardly foldable hinge points 12, 13, 16 and 17 provide the necessary rigidity of shape in this position. The intermediate layer 18 can be considered as a precaution against extreme lateral forces. A metal cross beam or strap can be applied in place of the timber 18, which can be inserted in existing, but not shown apertures in the upper angle frame 8 of the front wall 5 and of the back wall 4.

On folding open at the construction site and after bolting together the flanges and the hinge points, the rigidity of a non-foldable module is achieved since the hinge points 10 to 16 are not located at the module corners. The hinges 12.10 are auxiliary hinges and can be removed if necessary in the assembled state of the module 1.

As stated above, the inclined space or gap 12.6 at the hinge point 12, and similar gaps (not shown) at the hinge points 13, 16 and 17, provide a mechanical fixation of the folded together module 1 with the existing connecting means, because a portion of the lower angle frame 7 projects from the module leg 5.1 with the aperture 12.4 in alignment below the aperture 12.2 of the hinge lug. In this way, a bolt can then be inserted at each of the four hinge points 12, 11, 14 and 15, and the folded together module 1 blocked mechanically in this position by tightening the bolts. The described principle could, for example, also be utilized for plank partitions and as a cover, or door hold open security device.

The prefabricated elevator shaft module according to the present invention is formed from a plurality of generally vertically extending walls including a pair of side walls spaced apart a first predetermined distance and connected to each other by front and rear walls. Each of the side walls is foldable along two generally vertically extending axes, one of the axes being foldable inwardly and the other axis being foldable outwardly. When the side walls are folded, they are spaced from each other by a second predetermined distance less than the first predetermined distance, for example, one third.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A prefabricated elevator shaft module for the construction of complete elevator shafts in building structures comprising: a plurality of generally vertically extending walls connected together to form a multi-sided module including a pair of spaced apart side walls connected together by a front wall and a rear wall spaced apart a first predetermined distance, each of said spaced apart side walls being foldable along at least one generally vertically extending axis whereby, when said spaced apart side walls are folded, said spaced apart front and rear walls are spaced from each other by a second predetermined distance less than said first predetermined distance.

2. The elevator shaft module according to claim 1 wherein the module has a rectangular cross section in its erected position and said spaced apart side walls include four hinges at points defining said vertically extending axes, two of said hinges being the same distance from the ends of a first one of said spaced apart side walls as the other two hinges are from the ends of the other one of said spaced apart side walls.

3. The elevator shaft module according to claim 1 wherein each of said walls is formed from a plurality of identical individual elements.

4. The elevator shaft module according to claim 1 including upper and lower angle frames attached to upper and lower edges respectively of said walls.

5. The elevator shaft module according to claim 4 including a pair of hinge points associated with each of said axes, each of said hinge points including a hinge lug having one portion fixedly attached to said side wall on one side of an associated one of said axes and another portion detachably attached to said side wall on an opposite side of said associated axis.

6. The elevator shaft module according to claim 1 wherein said second predetermined distance is approximately one third of said first predetermined distance.

7. A prefabricated elevator shaft module for the construction of complete elevator shafts in building structures comprising: a plurality of generally vertically extending walls including a pair of side walls connected to each other by front and rear walls spaced apart a first predetermined distance, each of said side walls being foldable along two generally vertically extending axes, one of said axes being foldable inwardly and the other axis being foldable outwardly, whereby when said side walls are folded, said front and rear walls are spaced from each other by a second predetermined distance less than said first predetermined distance.

8. The elevator shaft module according to claim 7 wherein the module has a rectangular cross section in its erected position and said side walls include four hinges at points defining said vertically extending axes, two of said hinges being the same distance from the ends of a first one of said side walls as the other two other hinges are from the ends of the other one of said side walls.

9. A prefabricated elevator shaft module for the construction of complete elevator shafts in building structures comprising: a plurality of generally vertically extending walls including a pair of said walls connected to each other by front and rear walls spaced apart a first predetermined distance, each of said side walls being foldable along two generally vertically extending axes to space said front and rear walls from each other by a second predetermined distance less than said first predetermined distance, each of said walls being formed from a plurality of identical individual elements, and including upper and lower angle frames attached to upper and lower edges respectively of said walls.

10. The elevator shaft module according to claim 9 wherein each of said side walls is foldable outwardly along one of said axes and is foldable inwardly along the other one of said axes.

11. The elevator shaft module according to claim 9 wherein one of said axes is defined at abutting edges of adjacent ones of said individual elements and each of said upper and lower angle frames has a gap formed therein as a continuation of said one axis and including a pair of hinge lugs each having one portion fixedly attached to an associated one of said angle frames on one side of said gaps and another portion detachable attached to an associated one of said angle frames on the other side of said gaps to permit said side walls to fold outwardly along said one axis.

12. The elevator shaft module according to claim 9 wherein one of said axes is defined at abutting edges of adjacent ones of said individual elements and each of said upper and lower angle frames has a gap formed therein as a continuation of said one axis and horizontally at an angle to said one axis, and including a pair of hinge lugs each having one portion fixedly attached to an associated one of said angle frames on one side of said gaps and another portion detachably attached to an associated one of said angle frames on the other side of said gaps to permit said side walls to fold inwardly along said one axis.

13. The elevator shaft module according to claim 12 wherein said hinge lugs and said angle frames each have an aperture formed therein for retaining a bolt to fix said side walls in a folded position.

* * * * *